United States Patent [19]

Gould

[11] 4,197,192

[45] Apr. 8, 1980

[54] VANADIUM AND NICKEL REMOVAL FROM PETROLEUM UTILIZING ORGANIC PEROXYACID

[75] Inventor: Kenneth A. Gould, Berkeley Heights, N.J.

[73] Assignee: Exxon Research & Engineering Co., Florham Park, N.J.

[21] Appl. No.: 953,364

[22] Filed: Oct. 23, 1978

[51] Int. Cl.[2] ..... C10G 17/10

[52] U.S. Cl. ..... 208/252

[58] Field of Search ..... 208/251 R, 252

[56] References Cited

U.S. PATENT DOCUMENTS

| | | | |
|---|---|---|---|
| 2,767,123 | 10/1956 | Hickok et al. | 208/252 |
| 2,778,777 | 1/1957 | Powell | 208/251 R |
| 2,934,497 | 4/1960 | Bieber et al. | 208/251 R |
| 2,976,233 | 3/1961 | Selbin | 208/251 R |
| 3,162,598 | 12/1964 | Disegna | 208/252 |

OTHER PUBLICATIONS

Sugihara, J. M. et al., "Oxidative Demetalation of Oxovanadium Porphyrins," ACS, Division of Petroleum Chemistry, vol. 18, (4), pp. 645-647, (1973).

*Primary Examiner*—George Crasanakis
*Attorney, Agent, or Firm*—David W. Collins; Jerome E. Luecke

[57] ABSTRACT

Vanadium and nickel levels in petroleum feeds are decreased by oxidation of the feed prior to the usual processing or upgrading steps. An organic peroxyacid is used in the oxidation. The reduction in vanadium and nickel levels results in increased lifetime of catalysts used in subsequent processing steps such as in hydrodesulfurization or catalytic cracking.

20 Claims, No Drawings

VANADIUM AND NICKEL REMOVAL FROM PETROLEUM UTILIZING ORGANIC PEROXYACID

BACKGROUND OF THE INVENTION

1. Field of the Invention

The present invention relates to the upgrading of hydrocarbon oils and, more particularly, relates to an improved process for removing metallic contaminants from petroleum feeds, especially high boiling fractions.

2. Discussion of the Prior Art

The adverse effects of nickel, vanadium and other metallic contaminants found in petroleum fractions boiling above about 950° F. upon catalysts employed in petroleum processing operations and upon combustion equipment in which such high boiling fractions are used as fuels have long been recognized. In catalytic cracking operations, for example, very small concentrations of such contaminants in the feed to the cracking unit lead to the rapid poisoning of the catalyst, causing a significant decrease in the yield of cracked products, an increase in the production of coke and gases and a marked shortening of the catalyst life. Metallic contaminants present in residual fuels have similarly deleterious effects in that they (1) attack the refractories used to line boilers and combustion chambers, (2) cause slagging and deposits on boiler tubes, combustion chamber walls and blades of gas turbines and (3) severely corrode high temperature metallic surfaces with which they come in contact.

Much research has been devoted to the problem of developing methods for removing metallic contaminants from high boiling petroleum fractions in order to overcome these difficulties. Exemplary of such work are U.S. Pat. No. 3,203,892 and 3,245,902, which disclose demetallization of high boiling petroleum fractions by treating the contaminated fraction with hydrofluoric acid in the liquid phase.

Various oxidizing agents have also been employed in treating crude oil to remove vanadium complexed with porphyrins; see ACS Division of Petroleum Chemistry, Volume 18, pages 645–647 (1973). Among the oxidizing agents disclosed are $Cl_2$, $SO_2Cl_2$, $N_2O_4$, t-butyl hydroperoxide and benzoyl peroxide. However, chlorine-containing reagents result in incorporation of chlorine in the feed, which renders the feed more corrosive and hence less processable. The remaining reagents disclosed are not as effective in reducing vanadium content as are the chlorine-containing reagents, which typically reduce the vanadium content to about one-half the original value.

SUMMARY OF THE INVENTION

In accordance with the invention, metal contaminants are reduced in a petroleum feed by treating the feed in the liquid phase at a temperature of less than about 50° C. with an organic peroxyacid, followed by contacting the feed with an aqueous solution. The peroxyacid may be either added directly to the hydrocarbon phase or may be generated in situ. In the latter case, an organic acid capable of forming a peroxyacid is added to the hydrocarbon fraction, followed by addition of a mild oxidant at a rate so as to maintain the temperature less than about 50° C. The mild oxidant oxidizes the organic acid to form the corresponding peroxyacid, which in turn oxidizes the metal contaminants. During the oxidation of the metal contaminants, the peroxyacid is reduced back to the acid, which is then separated from the hydrocarbon phase into an aqueous phase and recycled. In any event, the oxidized vanadium and nickel species are extracted in the aqueous phase, along with spent acid.

As a consequence of treating petroleum feeds having a high metals content with an organic peroxyacid, a considerable reduction in vanadium and nickel levels is obtained. The demetallized petroleum fraction may then be further processed in accordance with the usual petroleum procedures, such as hydrodesulfurization and the like. Catalysts employed in such reactions which ordinarily are poisoned by high metals content in the petroleum feed evidence longer life as a consequence of the peroxyacid treatment disclosed above.

DETAILED DESCRIPTION OF THE INVENTION

Although the feedstream of any petroleum fraction, regardless of source, may be beneficially processed in accordance with the invention, the inventive process is especially useful for treating heavy metal-containing fractions such as resids and asphaltenes derived from highly contaminated crudes such as Cold Lake and Arabian Heavy. The vanadium content of such asphaltenes typically ranges from over 500 to nearly 1000 parts per million (ppm) and the nickel content typically ranges from about 150 to nearly 400 ppm. For comparison, low contamination crudes such as Louisiana evidence vanadium and nickel concentrations of under 10 ppm total for the entire crude.

The petroleum feed is treated in accordance with the invention with an organic peroxyacid having the formula $R—CO_3H$, where R is hydrogen or an alkyl, aryl, cycloalkyl or heteroatomcontaining group. Examples of suitable organic peroxyacids useful in the practice of the invention include peroxyacetic acid, trifluoroperoxyacetic acid and m-chloroperoxybenzoic acid.

About 0.005 to 0.07 mole of peroxyacid per gram of feed, and preferably about 0.02 to 0.03 mole of peroxyacid per gram of feed, is employed, although some peroxyacids of greater or lesser reactivity than peroxyacetic acid may require correspondingly lesser or greater amounts of peroxyacid. Less than about 0.005 mole of peroxyacid per gram of feed is generally only marginally beneficial, while greater than about 0.07 mole of peroxyacid per gram of feed does not usually result in any significantly greater reduction of metals contamination. For peroxyacetic acid, on a weight basis, about 0.4 to 5.0 g/g of feed, and perferably about 1.5 to 2.0 g/g of feed, is employed.

The temperature of processing is conveniently done at ambient temperatures, and in any event less than about 50° C. in order to avoid volatilization of peroxyacid.

Under the foregoing conditions, no more than about four to six hours are required to complete the reaction. Less than about one hour is generally sufficient. During the course of the reaction, vanadium and nickel are apparently oxidized and decomplexed from their organic liquids, while the organic peroxyacid is reduced to the corresponding organic acid.

The treated feed is then contacted with an aqueous solution to recover spent acid. During the contacting, watersoluble decomplexed vanadium and nickel species are also separated from the feed. The metals and acid, if desired, may be recovered from the aqueous phase by conventional processing techniques. For example, acid is conveniently removed from the aqueous phase by distillation, while metals are conveniently removed by chelation. Other separation techniques may also be employed.

Under the preferred conditions described above, the amounts of vanadium and nickel contamination are reduced to less than half the values before oxidation. Further reduction may be obtained by exposing the feedstream to fresh peroxyacid.

An alternative to the foregoing process steps involves adding to the feedstream an organic acid, such as acetic acid, which is capable of generating a peroxyacid. A mild oxidant, such as 30% hydrogen peroxide, is then added, which converts the acid to the corresponding peroxyacid in situ. Hydrogen peroxide is preferred in view of its low cost and facile oxidation of the acid.

The amounts of acid and hydrogen peroxide are chosen so as to generate similar levels of peroxyacid as would be added by the foregoing procedure. Thus, about 0.005 to 0.07 mole of organic acid per gram of feed, and preferably about 0.02 to 0.03 mole of acid per gram of feed, plus hydrogen peroxide of substantially the same molar concentration as acid are employed. A slight excess of hydrogen peroxide may be used, if desired, to ensure substantially complete oxidation of the acid.

The addition of the mild oxidant is carried out under conditions so as to maintain the temperature of the system at less than about 50° C. Under such conditions, controlled generation of the peroxyacid is obtained. During oxidation of the feedstream, the peroxyacid is reduced back to the organic acid. The acid may then be stripped from the feed and recycled to fresh feed and reoxidized with fresh hydrogen peroxide. Stripping may be accomplished, for example, by contacting the feed with an aqueous solution. Since the acid is soluble in water, the acid is easily separated from the feedstream for recycling. The acid and water-soluble metal species may be recovered, if desirable, as disclosed above.

EXAMPLES

EXAMPLE 1

In a round bottom flask, 8.0 g of an asphaltene fraction was dissolved in 100 ml $CHCl_3$. Through an addition funnel, 30.0 g of 40% peroxyacetic acid solution was added at a rate so as to keep the reaction temperature below about 45° C. After completing the addition, the mixture was stirred overnight. As a laboratory precaution, any excess peroxyacetic acid not consumed in the reaction was destroyed by addition of Raney nickel. The mixture was then washed with water and with a 5% sodium bicarbonate solution. The oil layer was separated from the water layer, dried over sodium sulfate, filtered, evaporated and dried under vacuum at 80° C.

A number of asphaltenes were processed following the procedure given above. The asphaltenes and their vanadium and nickel contents before oxidation and after oxidation are listed in the Table below.

The analyses for vanadium and nickel were performed on aliquots taken before addition of Raney nickel in order to avoid contamination. From an examination of the Table, it is clear that treatment of the asphaltenes in accordance with the invention is effective in substantial reduction of vanadium and nickel levels. As might be expected, higher concentrations of peroxyacid increase the percent of demetallization, although the effect is not so pronounced for concentrations above 1.5 g/g of feed.

EFFECT OF PEROXYACETIC ACID OXIDATION ON VANADIUM AND NICKEL LEVELS

| Feed | Concentration, g oxidant/ g asphaltene | Before Oxidation | | After Oxidation | | | |
|---|---|---|---|---|---|---|---|
| | | V(ppm) | Ni(ppm) | V(ppm) | % Reduction | Ni(ppm) | % Reduction |
| Cold Lake Asphaltenes | 0.38 | 860 | 290 | 660 | 23.2 | 250 | 13.7 |
| Cold Lake Asphaltenes | 0.75 | 860 | 290 | 510 | 40.7 | 150 | 48.3 |
| Cold Lake Asphaltenes | 1.5 | 950 | 370 | 220 | 76.8 | — | — |
| Cold Lake Non-Basic Asphaltenes | 1.5 | 590 | 220 | 270 | 54.2 | 110 | 50.0 |
| Cold Lake Basic Asphaltenes | 1.5 | 650 | 290 | 250 | 61.5 | 140 | 51.8 |
| Cold Lake Asphaltenes | 1.5 | 950 | 370 | 260 | 72.5 | 190 | 48.6 |
| Cold Lake Asphaltenes | 3.0 | 860 | 290 | 170 | 80.2 | 100 | 65.5 |
| Arabian Heavy Asphaltenes | 1.5 | 570 | 170 | 160 | 71.9 | 70 | 58.9 |
| Arabian Heavy Non-Basic Asphaltenes | 1.5 | 520 | 150 | 140 | 73.1 | 90 | 40.0 |
| Arabian Heavy Basic Asphaltenes | 1.5 | 590 | 220 | 300 | 49.2 | — | — |

EXAMPLE 2

A 3.0 g portion of Cold Lake vacuum residuum (335 ppm vanadium; 133 ppm nickel) was treated with 11.3 g of 40% peroxyacetic acid (0.0595 mole) in 100 ml of chloroform, following the same procedure outlined in Example 1. The vanadium level was reduced to 67 ppm and the nickel level was reduced to 35 ppm, corresponding to demetallization levels (i.e., % reduction) of 80% and 74%, respectively.

EXAMPLE 3

A solution containing 2.0 g of Cold Lake asphaltenes (930 ppm vanadium; 350 ppm nickel) in 100 ml of chloroform was treated with 9.6 g of m-chloroperoxybenzoic acid (0.0557 mole) dissolved in 50 ml of chloroform, following the same procedure outlined in Example 1. The vanadium level was reduced to 483 ppm and the nickel level was reduced to 195 ppm, corresponding to demetallization levels of 48% and 44%, respectively.

EXAMPLE 4

A solution containing 2.0 g of Cold Lake asphaltenes (930 ppm vanadium; 350 ppm nickel) and 2.7 g of trifluoroacetic acid (0.0208 mole) in 100 ml of chloroform was treated with 8.8 g of 30% hydrogen peroxide, following the same procedure outlined in Example 1. Trifluoroperoxyacetic acid was generated in situ by the reaction of the trifluoroacetic acid and hydrogen peroxide. The vanadium level was reduced to 523 ppm and the nickel level was reduced to 249 ppm, corresponding to demetallization levels of 44% and 29%, respectively.

What is claimed is:

1. A process for reducing metal contaminants in a petroleum feed which comprises treating the feed in a liquid phase at a temperature of about less than 50° C. with an organic peroxyacid, followed by contacting the feed with an aqueous solution.

2. The process of claim 1 in which the petroleum feed boils at temperatures in excess of about 950° F. and contains nickel and vanadium impurities.

3. The process of claim 1 in which the amount of organic peroxyacid ranges from about 0.005 to 0.07 mole per gram of feed.

4. The process of claim 3 in which the amount of peroxyacid ranges from about 0.02 to 0.03 mole per gram of feed.

5. The process of claim 1 in which the peroxyacid is an alkyl, aryl, cycloalkyl or heteroatom-containing peroxyacid.

6. The process of claim 5 in which the peroxyacid is one selected from the group consisting of peroxyacetic acid, trifluoroperoxyacetic acid and m-chloroperoxybenzolic acid.

7. The process of claim 6 in which the peroxyacid is peroxyacetic acid.

8. The process of claim 1 in which the organic peroxyacid is generated in situ by mixing the feed with an organic acid capable of generating the organic peroxyacid upon reaction with hydrogen peroxide and adding sufficient hydrogen peroxide to generate said organic peroxyacid.

9. The process of claim 8 in which the amount of organic acid and hydrogen peroxide each range from about 0.005 to 0.07 moles per gram of feed.

10. The process of claim 9 in which th amount of organic acid and hydrogen peroxide each range from about 0.02 to 0.03 moles per gram of feed.

11. A process for reducing metal contaminants in a petroleum feed which comprises (a) adding an organic acid to the feed, (b) adding hydrogen peroxide at a rate so as to maintain the temperature less than about 50° C. to generate an organic peroxyacid in situ for treating said feed in liquid phase and (c) separating spent peroxyacid as organic acid from step (b) by contacting the feed with an aqueous solution.

12. The process of claim 11 in which the organic acid separated in step (c) is recovered and recycled to step (a).

13. The process of claim 11 in which the petroleum feed boils at temperatures in excess of about 950° F. and contains nickel and vanadium impurities.

14. The process of claim 9 in which the amount of organic acid ranges from about 0.005 to 0.07 mole per gram of feed.

15. The process of claim 14 in which the amount of organic acid ranges from about 0.02 to 0.03 mole per gram of feed.

16. The process of claim 11 in which the amount of hydrogen peroxide ranges from 0.005 to 0.07 mole per gram of feed.

17. The process of claim 16 in which the amount of hydrogen peroxide ranges from about 0.02 to 0.03 mole per gram of feed.

18. The process of claim 11 in which the peroxyacid generated is an alkyl, aryl or cycloalkyl or heteroatom-containing peroxyacid.

19. The process of claim 18 in which the organic peroxyacid generated is one selected from the group consisting of peroxyacetic acid, trifluoroperoxyacetic acid and m-chloroperoxybenzoic acid.

20. The process of claim 19 in which the peroxyacid generated is peroxyacetic acid.

* * * * *